US009221265B2

(12) United States Patent
Vodopivec

(10) Patent No.: US 9,221,265 B2
(45) Date of Patent: Dec. 29, 2015

(54) COMPENSATION DEVICE FOR A PRINTING HEAD AND PRINTING UNIT COMPRISING SAID COMPENSATION DEVICE

(71) Applicant: New System S.R.L., Gorizia (IT)

(72) Inventor: Jozef Vodopivec, Gorizia (IT)

(73) Assignee: New System S.R.L., Gorizia (IT)

( * ) Notice: Subject to any disclaimer, the term of this patent is extended or adjusted under 35 U.S.C. 154(b) by 0 days.

(21) Appl. No.: 14/050,909

(22) Filed: Oct. 10, 2013

(65) Prior Publication Data

US 2014/0111584 A1 Apr. 24, 2014

(30) Foreign Application Priority Data

Oct. 19, 2012 (IT) ..... VI2012A0276

(51) Int. Cl.

| | |
|---|---|
| ***B41J 2/185*** | (2006.01) |
| ***B41J 2/175*** | (2006.01) |
| ***B41J 2/17*** | (2006.01) |
| ***B41J 2/19*** | (2006.01) |

(52) U.S. Cl.

CPC ..... *B41J 2/1707* (2013.01); *B41J 2/175* (2013.01); *B41J 2/17513* (2013.01); *B41J 2/185* (2013.01); *B41J 2/19* (2013.01)

(58) Field of Classification Search

USPC ..... 347/90, 85, 84, 92, 94, 93

See application file for complete search history.

(56) References Cited

U.S. PATENT DOCUMENTS

| | | | |
|---|---|---|---|
| 1,941,991 | A | 1/1934 | Lubs et al. |
| 4,024,544 | A | 5/1977 | Vernon |
| 4,347,524 | A | 8/1982 | Engel et al. |
| 4,403,229 | A | 9/1983 | Barteck |
| 4,575,738 | A | 3/1986 | Sheufelt et al. |
| 4,737,801 | A | 4/1988 | Ichihashi et al. |
| 5,877,794 | A | 3/1999 | Takagi |
| 6,017,118 | A | 1/2000 | Gasvoda et al. |
| 6,460,986 | B2 | 10/2002 | Sasaki |
| 6,568,802 | B2 | 5/2003 | Galan et al. |
| 7,004,574 | B2 | 2/2006 | Neese et al. |
| 7,111,931 | B2 | 9/2006 | Amma et al. |
| 7,364,285 | B2 | 4/2008 | Murad et al. |

(Continued)

FOREIGN PATENT DOCUMENTS

| | | | |
|---|---|---|---|
| GB | 2161117 | A | 1/1986 |
| JP | 2009045919 | A * | 3/2009 |

(Continued)

*Primary Examiner* — Julian Huffman
*Assistant Examiner* — Leonard S Liang
(74) *Attorney, Agent, or Firm* — Sughrue Mion, PLLC

(57) ABSTRACT

A compensation device configured to attenuate pressure variations in an ink printing head is provided. The device includes a first compensation chamber containing ink and having a bottom, an outlet orifice extending through the bottom, and an inlet orifice opposite the bottom; a second compensation chamber containing ink and having a bottom, an inlet orifice extending through the bottom, and an outlet orifice opposite the bottom; and a vent means allowing outflow of air contained in the compensation chambers. The vent means includes a first opening in the first compensation chamber; a second opening in the second compensation chamber operable to be in a lower position with respect to the first opening when the device is in an operating position in which the bottoms of the compensation chambers define lower walls of the corresponding compensation chambers; and an intermediate chamber communicating with the first opening and the second opening.

11 Claims, 3 Drawing Sheets

(56) References Cited

U.S. PATENT DOCUMENTS

| | | | | |
|---|---|---|---|---|
| 7,370,923 | B2 | 5/2008 | Tanno et al. | |
| 7,475,976 | B2 | 1/2009 | Brown et al. | |
| 7,645,034 | B2 | 1/2010 | Brown et al. | |
| 7,837,297 | B2 | 11/2010 | Brown et al. | |
| 7,922,312 | B2 | 4/2011 | Haines et al. | |
| 7,963,642 | B2 | 6/2011 | Umeda | |
| 8,020,965 | B2 | 9/2011 | Brown et al. | |
| 8,196,544 | B2 | 6/2012 | Fumo et al. | |
| 2003/0071865 | A1* | 4/2003 | Mott et al. | 347/18 |
| 2004/0263596 | A1 | 12/2004 | Watanabe et al. | |
| 2007/0285474 | A1 | 12/2007 | Murakami | |
| 2008/0084464 | A1 | 4/2008 | Saga et al. | |
| 2008/0246823 | A1 | 10/2008 | Comas et al. | |
| 2009/0160915 | A1* | 6/2009 | Takahashi et al. | 347/85 |
| 2010/0045757 | A1 | 2/2010 | Ito | |
| 2010/0149294 | A1 | 6/2010 | Brown et al. | |
| 2011/0074840 | A1 | 3/2011 | Nishimura et al. | |
| 2012/0218358 | A1 | 8/2012 | Okazawa | |

FOREIGN PATENT DOCUMENTS

| | | | |
|---|---|---|---|
| WO | 91/17052 | A1 | 11/1991 |
| WO | 2012/115654 | A1 | 8/2012 |

* cited by examiner

COMPENSATION DEVICE FOR A PRINTING HEAD AND PRINTING UNIT COMPRISING SAID COMPENSATION DEVICE

The present invention concerns a compensation device suited to attenuate pressure perturbations in an ink feeding a printing head.

The present invention also concerns a printing unit using said compensation device.

FIG. 1 schematically shows an ink jet printing unit of the known type, indicated as a whole by A.

Printing unit A comprises a printing head C provided with a printing surface N on which there is a plurality of nozzles that can be operated selectively to dispense a liquid ink.

The printing head C is fed through a feed duct R connected to a levelling tank O.

In order to ensure the correct operation of the printing unit, it is necessary to maintain the ink pressure inside the printing head as constant as possible and finely tuned compared to the atmospheric pressure.

As is known, these requisites are satisfied by placing the levelling tank O in an exactly defined vertical position with respect to the printing surface N, in such a way as to obtain, at the level of the nozzles, a predefined static pressure relative to the atmospheric pressure.

Due to the vibrations to which the feed duct R is subjected during the movements of the printing head C, the ink contained in the feed duct is subjected to pressure perturbations that, being transmitted to the printing head, may affect its correct operation.

To prevent the above, a compensation device B is used to attenuate the ink pressure perturbations, preventing them from being transmitted to the printing head C.

Compensation device B comprises a first compensation chamber D, arranged between the feed duct R and the printing head C.

The first compensation chamber D is filled with ink only partially, so that an air volume is trapped at its top, said air volume being capable of absorbing the ink pressure variations transmitted by the feed duct R.

The feed duct R extends inside the first compensation chamber D until almost reaching its bottom, so that the open end of the duct is immersed in the ink.

This way, the feed duct R remains constantly filled with ink and is thus able to perform its feeding function correctly.

When pressure in the feed duct R increases with respect to its normal value, the ink flows towards the first compensation chamber D, raising the ink level inside the chamber.

The above mentioned level increase absorbs the pressure increase almost completely and limits the transmission of the pressure to the printing head C.

Analogously, a pressure decrease in the feed duct R is compensated for by a reduction in the ink level in first compensation chamber D. Another issue that has to be dealt with regarding printing unit A is the need to periodically remove the air that progressively enters the printing head C through its nozzles during normal operation.

Such air hinders the correct feeding of the nozzles and negatively affects the printing procedure, therefore it must be periodically removed.

A common way for air removal is by increasing the pressure in the levelling tank O, in such a way as to force the ink to flow towards the printing head C.

The excess ink flows out of the printing head C towards a collection tank P through a discharge duct S.

The passage of ink through the printing head C drives the air present therein and moves it towards the collection tank P, from which it is vented using means known in the art.

Obviously, during normal operation of the printing unit, the discharge duct S causes in the printing head C pressure perturbations that are very similar to those caused by the feed duct R.

In order to prevent the transmission of said perturbations to the printing head C, a second compensation chamber G is used, which is interposed between the printing head C and the discharge duct S and is analogous to the first compensation chamber D.

The printing unit A of the known type described above poses a series of drawbacks.

First of all, before starting the printing process, the two compensation chambers D and G must be filled in such a way as to guarantee the correct level of ink in each one of them.

For this purpose, an air valve M is provided and associated with each chamber D and G, said air valve M being suited to be operated manually so that it is possible to monitor the filling of the respective chamber.

Furthermore, each of the chambers D and G is provided with a respective inspection window through which the operator can check the ink level.

At the beginning of the filling operation, the two air valves M are opened so that the air can flow out of each compensation chamber and thus allow it to be filled with ink.

When the ink level in each compensation chamber D, G has reached the pre-set value, the operator closes the corresponding valve M so as to prevent further air escape, in fact the air remains trapped in the chamber.

The above mentioned procedure, which must be carried out for each one of the two compensation chambers D and G, is one of the main drawbacks of the current systems as it requires the constant presence of an operator to allow prompt human intervention when needed.

In addition, human intervention may be a source for errors, for instance due to the fact that it may be difficult for the operator to timely intervening so as to close the air valves at the precise moment the ink reaches the pre-set value.

A filling procedure performed incorrectly affects the operation of the printing head negatively and therefore must be repeated, thus increasing the machine's standstill time and causing further costs.

The printing unit A described above poses the further drawback that the air valves M require periodic maintenance with the consequent maintenance costs.

A further drawback, related to the presence of the inspection windows, is represented by the risk that tightness between the latter and the corresponding chambers worsen over time, due to the aggressiveness of the inks commonly used, and to the difficulty to check the full compatibility in the long term between all the different inks that could be used and the window's seals.

Obviously, a loss of tightness of the windows requires the replacement of the entire compensation device or at least maintenance of the same.

The above mentioned printing unit A poses a further drawback related to the need to periodically remove air from the printing head, as explained above.

More precisely, the air removed from the printing head, which is forced towards the second compensation chamber G, tends to accumulate in the upper part of this chamber, from which it cannot escape spontaneously as the end of the discharge duct S is immersed in the ink, as mentioned above.

Therefore, also in this case the operator must intervene and open the air valve M of the second compensation chamber G so as to restore the correct ink level.

It can be understood that the above mentioned manual intervention involves drawbacks that are analogous to those described above with reference to the filling of the printing unit A.

The present invention aims to overcome the drawbacks described above, which are typical to printing units according to the known art.

In particular, it is the object of the present invention to provide a compensation device for an ink jet printing unit that requires fewer operator interventions compared to the printing units of the known type described above.

In particular, it is the object of the invention that the filling of the printing unit and the periodical removal of air from the printing head can be performed automatically, with no need for the intervention of the operator.

It is another object of the invention to provide a compensation device whose structure and operation are simpler compared to the compensation devices of the known type.

Said objects are achieved by a compensation device for a printing unit carried out according to claim 1.

Said objects are also achieved by a printing unit comprising said compensation device, according to claim 6.

The said objects, together with others advantages which will be highlighted below, are illustrated in the following description of preferred embodiments of the invention which is provided by way of non-limiting example with reference to the attached drawings, wherein.

Figure 2:
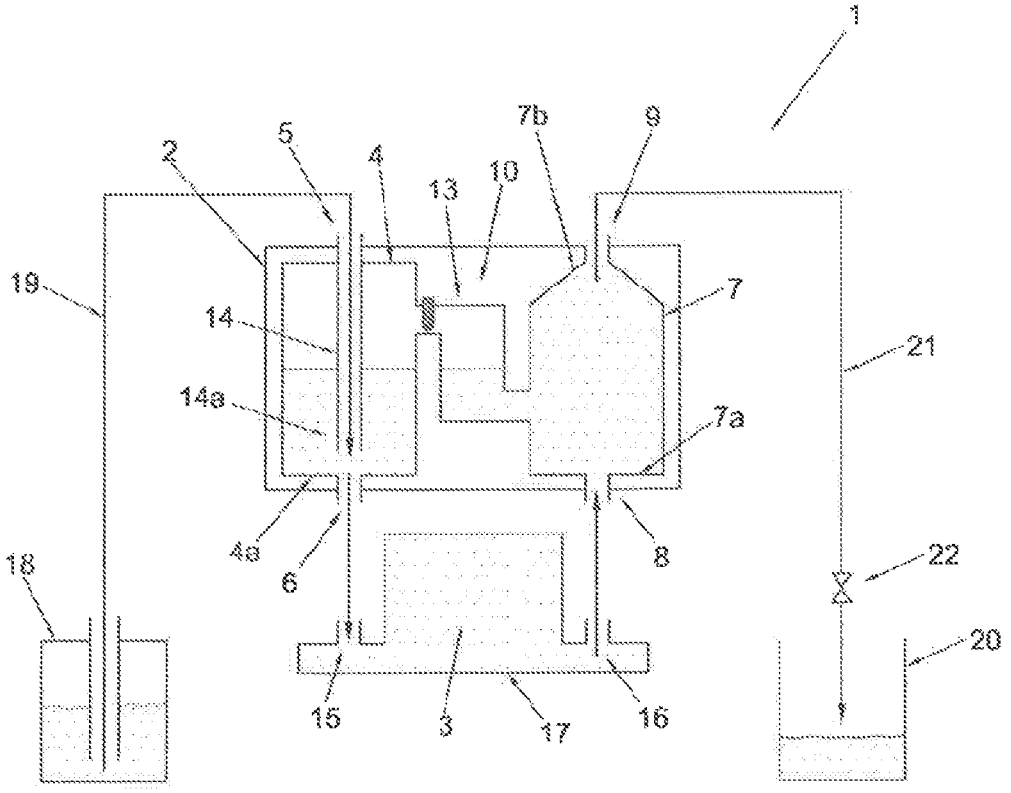
FIG. 2 shows a schematic view of a printing unit according to a preferred embodiment of the invention.

Reference is now made to FIG. 2 which shows a schematic view of a compensation device 2 according to a preferred embodiment of the invention, when used in a printing unit indicated as a whole by 1.

It is evident, on the other hand, that in construction variants of the invention the compensation device 2 can be used in printing units different from the one illustrated in the figure.

Said printing unit 1 comprises a printing head 3 provided with a plurality of nozzles (not shown) arranged on printing surface 17 configured for the ejection of a liquid ink.

The nozzles may be of any known type such as piezoelectric type.

The ink gets into the printing head 3 through a feeding orifice 15 that is placed in communication with the nozzles and connected to a levelling tank 18 preferably through a feed duct 19.

In particular, during operation of the printing unit 1, the ink in the levelling tank 18 is kept at a lower level with respect to the nozzles of the printing head 3.

In this way, the nozzles are maintained at a pressure slightly lower than the atmospheric pressure in such a way as to prevent the ink from accidentally flowing out of the nozzles.

The printing head 3 also comprises a discharge outlet 16 connected to a collection tank 20 through a discharge duct 21 and suited to allow the excess ink to flow out during the filling and recirculation operations mentioned above and described in greater detail here below.

Preferably, both feed duct 19 and discharge duct 21 are flexible, in order to follow the movement of the printing head 3 with respect to the levelling tank 18 and to the collection tank 20 during printing operation.

A preferably motor-operated valve 22 is also provided, which is arranged along the discharge duct 21 and is suited to open and close the discharge duct 21 during said filling and recirculation operations. The printing unit 1 comprises also a compensation device 2 suited to attenuate the pressure variations in the ink caused, for example, by the vibrations of the ducts 19, 21 during operation of the printing unit 1.

Figure 3:
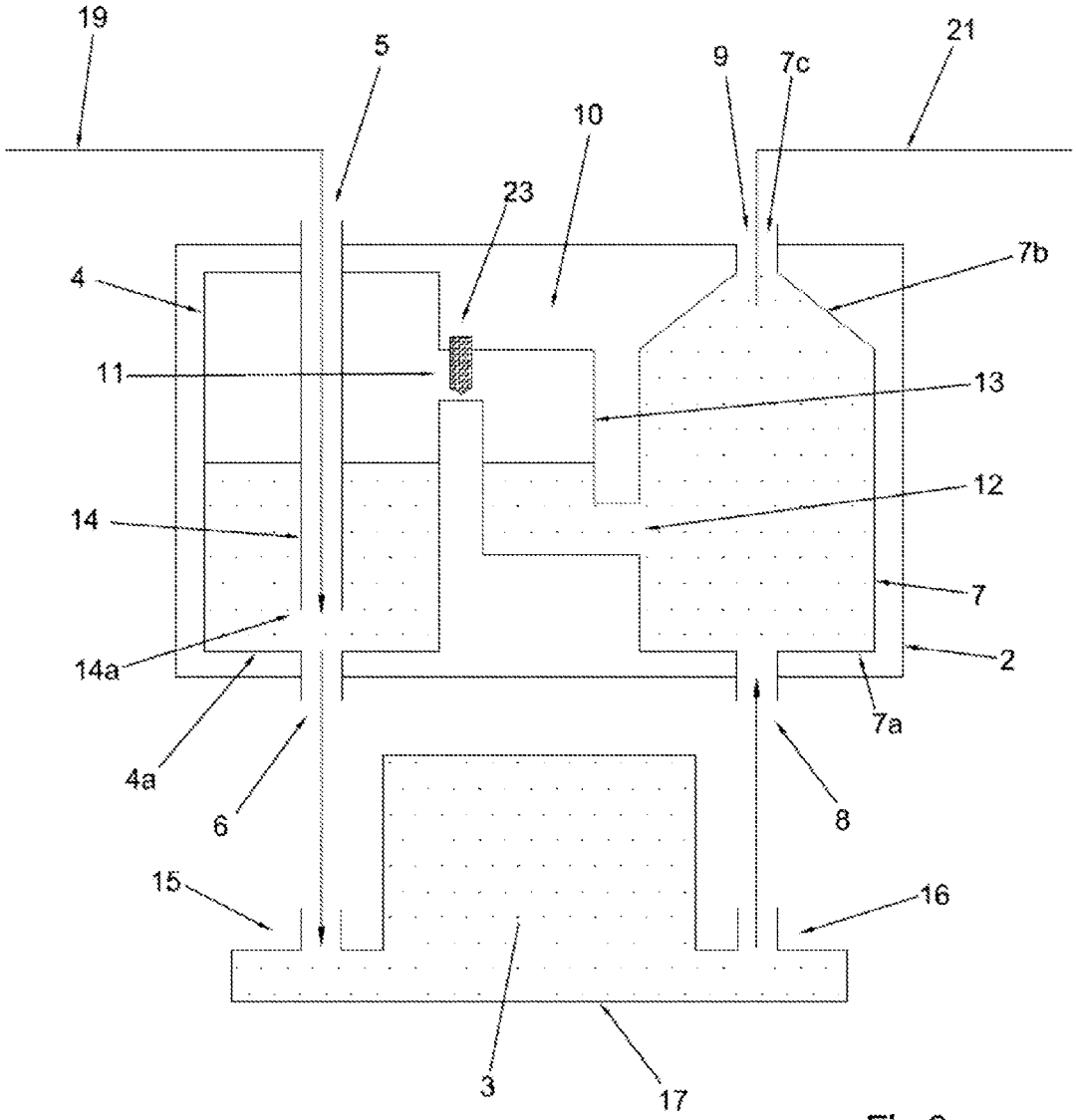
FIG. 3 shows an enlarged detail of FIG. 2.

As shown in detail in FIG. 3, the compensation device 2 comprises a first compensation chamber 4 partially filled with ink and provided with an outlet orifice 6, belonging to the bottom 4*a* of the chamber itself, and with an inlet orifice 5 opposite said bottom 4*a*.

In particular, the inlet orifice 5 communicates with the levelling tank 18 through the feed duct 19 mentioned above, while the outlet orifice 6 is in communication with the feeding orifice 15 of the printing head 3.

The feed duct 19 extends inside the first compensation chamber 4 in such a way as to define a conveyance duct 14 provided with an open end 14*a* immersed in the ink present therein.

The compensation device 2 comprises also a second compensation chamber 7 that is provided with an inlet orifice 8 belonging to the bottom 7*a* of the chamber itself, and with an outlet orifice 9 opposite said bottom 7*a*.

In particular, the inlet orifice 8 of the second compensation chamber 7 communicates with the discharge outlet 16 of the printing head 3, while the outlet orifice 9 of said second compensation chamber 7 communicates with the collection tank 20 through the discharge duct 21 mentioned above.

It is specified since now that hereinafter, and if not specified otherwise, the compensation device 2 will be intended as arranged in an operating position in which the compensation chambers 4 and 7 are arranged with their respective bottoms 4*a* and 7*a* in lower position, as shown in the figures.

The compensation device 2 comprises also vent means 10 that allow the air contained in the compensation chambers 4 and 7 to flow out while said chambers are being filled with ink.

According to the invention, the vent means 10 comprise an intermediate chamber 13 communicating with the first compensation chamber 4 through a first opening 11, arranged in a lower position with respect to the inlet orifice 5 of the first chamber 4 and in an upper position with respect to the open end 14*a* of the conveyance duct 14.

The intermediate chamber 13 communicates also with the second compensation chamber 7 through a second opening 12 arranged in a lower position with respect to said first opening 11.

Figure 1:
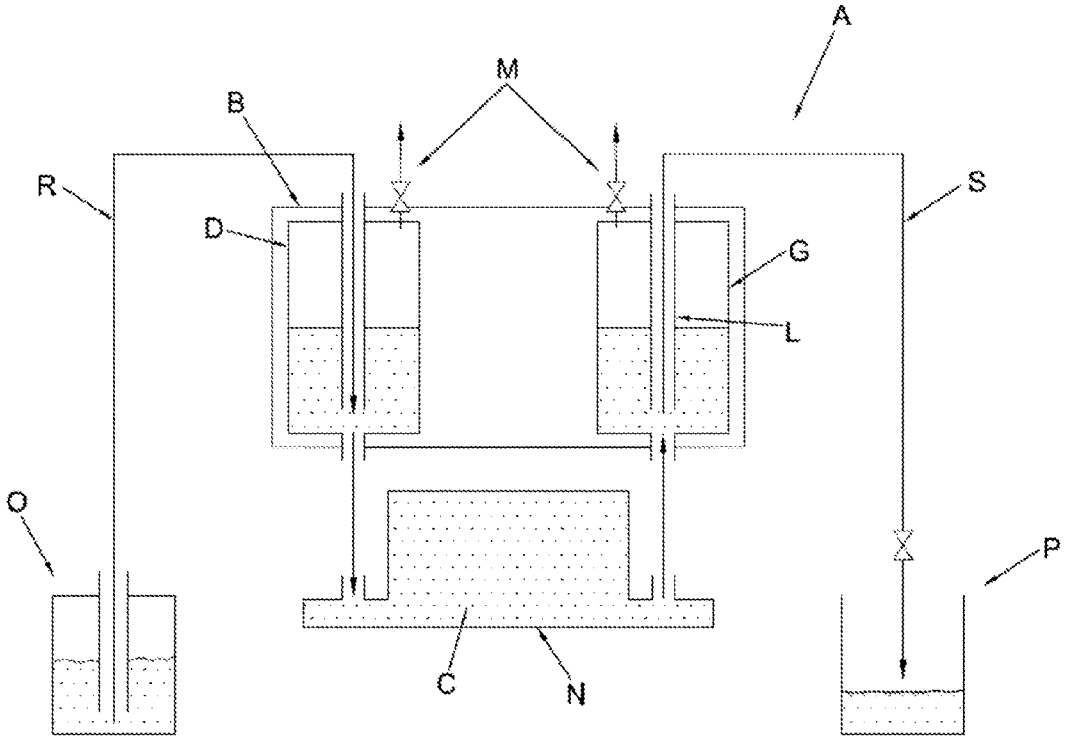
FIG. 1 shows a schematic view of a printing unit according to the known art.

Intermediate chamber 13 makes it possible to avoid the need for using vent valves on each one of the compensation chambers 4 and 7, which are required in current systems (reference M in FIG. 1).

The filling of the printing unit 1 with ink is carried out by generating over pressure in the levelling tank 18, thus pushing the ink through the feed duct 19 towards the first compensation chamber 4.

During this operation, the air present inside the first compensation chamber 4 flows out through the outlet orifice 9 of the second compensation chamber 7, passing through the intermediate chamber 13 that places the two compensation chambers 4 and 7 in communication with each other.

When the level of ink in the first compensation chamber 4 reaches the first opening 11, the ink starts flowing towards the second compensation chamber 7 through the intermediate chamber 13.

In addition to the above, the additional increase in the ink level in the first compensation chamber 4 causes the obstruction of the first opening 11 and thus prevents any further outflow of air from the first compensation chamber 4.

Consequently, an air volume remains trapped in the first compensation chamber 4, said air volume corresponding to the volume of the portion of the first compensation chamber 4 located above the first opening 11 at a pressure corresponding to the overpressure in the levelling tank 18.

When also the second compensation chamber 7 has filled with ink and the latter starts flowing out through the corresponding outlet orifice 9 to reach the collection tank 20, the motor-operated valve 22 is closed so as to stabilize the system.

Successively, the levelling tank 18 is brought back to atmospheric pressure conditions, allowing the air contained in the first compensation chamber 4 to expand.

Said expansion causes the outflow of part of the ink present in the chambers 4, 7 and 13 towards the levelling tank 18 and the simultaneous decrease in the ink level in the first compensation chamber 4 and in the intermediate chamber 13 below the first opening 11.

At this point, the system is ready for printing.

It can be understood that in this condition the compensation device 2 is able to attenuate the pressure variations towards the printing head 3 in a way that is analogous to the process that takes place in the compensation devices of the known type.

In fact, any pressure variations in the feed duct 19 are attenuated by a temporary variation in the ink level in the first compensation chamber 4.

Analogously, temporary pressure variations in the discharge duct 21 are attenuated by a variation in the ink level in the intermediate chamber 13.

In any case, the air present in the compensation device 2 remains unchanged, as its outflow is prevented by the presence of ink in the intermediate chamber 13, which obstructs the second opening 12.

It can thus be understood that the compensation device 2 described above makes it possible to carry out the filling operations with no need for the operator to release the excess air from the first compensation chamber 4, as the air is free to flow out through the first opening 11 until this is obstructed by the ink.

Therefore, the invention achieves the object to reduce the need for operator interventions during the filling of the printing unit 1.

Regarding the volumes of the three chambers 4, 7 and 13 defined in particular by the cross section of the chambers and by the position of the first opening 11 and of the second opening 12, these are such that the compensation device 2 as a whole can attenuate predetermined pressure variations which are those to be expected for the specific application for which the printing unit 1 is intended.

In particular, the air trapped in the first compensation chamber 4 is such that, in conditions of minimum pressure expected in this chamber, the ink level remains above the open end 14*a* of the conveyance duct 14.

Analogously, the position of the second opening 12 is such that, in conditions of minimum pressure expected in the second compensation chamber 7, the air level in the intermediate chamber 13 does not lower below the second opening 12.

Both said conditions avoid the outflow of air through the feed duct 19 and the discharge duct 21 after the first filling of the compensation device 2.

Preferably, a first circuit defined by the first opening 11, by the intermediate chamber 13 and by the second opening 12 is configured in such a way as to generate an overall resistance to the outflow of ink exceeding the overall resistance generated by a second circuit defined by the outlet orifice 6 of the first compensation chamber 4, by the printing head 3 and by the inlet orifice 8 of the second compensation chamber 7.

Due to the configuration just described above, the outflow of the ink from the first compensation chamber 4 towards the second compensation chamber 7 during the filling of the printing unit 1 is greater along the second circuit, that is, through the printing head 3, and smaller along the first circuit, that is, through the intermediate chamber 13.

This advantageously slows down the outflow of the ink coming from the intermediate chamber 13 towards the second compensation chamber 7, preventing it from hindering the air that flows out of the printing head 3 in the opposite direction.

Preferably, the greater overall resistance required for the first circuit is obtained through setting means 23 suited to define a predetermined passage section in the first opening 11.

Preferably, said setting means 23 are adjustable, so that it is possible to adapt the compensation device 2 to different conditions of use, including, for example, different geometric shapes of the feed and discharge ducts and/or inks having different physical characteristics.

Obviously, variant embodiments of the invention intended for specific uses may include non-adjustable setting means 23 that preferably comprise a precisely defined first opening 11.

Regarding the second compensation chamber 7, the respective outlet orifice 9 communicates with the inside of the second compensation chamber 7 preferably through a hole 7*c* belonging to the upper wall 7*b* of the second compensation chamber 7 opposite the bottom 7*a* of the latter.

In other words, the discharge duct 21 does not extend inside the second compensation chamber 7, as is the case, instead, for the compensation devices constructed according to the known art.

Consequently, the air is free to flow out of the top of the second compensation chamber 7, which in normal conditions is full of ink.

To facilitating the outflow of air, the upper wall 7*b* is preferably concave towards the inside of the second compensation chamber 7 and the hole 7*c* is arranged at the top of the above mentioned concave upper wall.

It is thus understood that filling the second compensation chamber 7 with ink does not affect the operation of the compensation device 2. In fact, as explained above, the attenuation of the pressure variations in the second compensation chamber 7 is ensured by the intermediate chamber 13.

Another advantage of the preferred configuration of second compensation chamber 7, as described above, is that it prevents the accumulation of air therein and therefore it may obviate the need to for air valves, or at least reduce their importance for the proper operation of the system.

Therefore, advantageously, the need for operator interventions is further reduced compared to the compensation devices of the known type.

In particular, the absence of air valves in the two compensation chambers 4 and 7 allows a completely automatic filling of the printing unit 1 to be performed.

Furthermore, the fact that the air can easily flow out of the second compensation chamber 7 facilitates also the removal of the air that accumulates inside the printing head 3 during operation, as a consequence of the situation described above.

Hence, accumulated air can be removed from the printing head 3 through a recirculation operation that is analogous to that used in the printing units of the known type, i.e. by increasing the pressure in the levelling tank 18 in such a way as to force the ink from the first compensation chamber 4 to the second compensation chamber 7 through printing head 3, thus driving the air accumulated in the printing head 3 towards the collection tank 20, from which the air can be vented.

However, as in the compensation device 2 of the invention the air that passes from the printing head 3 towards the second compensation chamber 7 flows freely out of the latter, no manual venting operation is needed, differently from what happens with the compensation devices of the known type.

Therefore, advantageously, the recirculation operation can be completely automatic as well as the filling operation.

Still advantageously, the possibility to avoid using air valves allows for simplification of the compensation device 2, as well as reduction of its maintenance costs, compared to those belonging to the known art.

Moreover, as it is not necessary for the operator to check the ink level in the two compensation chambers 4 and 7, the latter do not need to be provided with inspection windows of the type used in the known art, with the advantage of avoiding the corresponding drawbacks.

According to an embodiment of the invention, not shown in the drawings, the compensation device 2 may have a multiplicity of outlet orifices 6 in the first compensation chamber 4 and of inlet orifice 8 in the second compensation chamber 7.

Advantageously, the outlet orifices 6 and the inlet orifices 8 allow connecting the compensation device 2 to several printing head 3 arranged in parallel to one another, so as to being capable to feed them simultaneously.

The above clearly shows that the compensation device described above and the printing unit comprising said device achieve all the objects of the invention.

In particular, the absence of air valves, made possible by the presence of the intermediate chamber, substantially limits operator interventions compared to the compensation devices of the known type, especially during the ink refilling and recirculation operations.

Furthermore, the absence of air valves and inspection windows contributes to reducing maintenance on the compensation device.

Moreover, the absence of air valves and moving parts in the compensation device of the invention makes it simpler than the compensation devices of the known type from a constructional point of view.

The invention claimed is:

1. A compensation device, comprising:

a first compensation chamber configured to contain ink, said first compensation chamber comprising a bottom wall, an outlet orifice extending through said bottom wall, and an inlet orifice opposite said bottom wall;

a second compensation chamber configured to contain ink, said second compensation chamber comprising a bottom wall, an inlet orifice extending through said bottom wall, and an outlet orifice opposite said bottom wall;

a vent means configured to allow an outflow of air from said first compensation chamber and from said second compensation chamber;

wherein said vent means comprises:

a first opening in said first compensation chamber, wherein the first opening is separate from the outlet orifice of the first compensation chamber and from the inlet orifice of the first compensation chamber;

a second opening in said second compensation chamber, wherein the second opening is separate from the outlet orifice of the second compensation chamber and from the inlet orifice of the second compensation chamber, wherein said second opening is positioned lower than said first opening when said compensation device is in an operating position in which said bottom wall of said first compensation chamber and said bottom wall of said second compensation chamber respectively define a lowermost wall of said first compensation chamber and a lowermost wall of said second compensation chamber; and an intermediate chamber, wherein said first opening is in communication with said second opening via said intermediate chamber.

2. The compensation device according to claim 1, wherein in said operating position, said first opening is disposed below said inlet orifice of said first compensation chamber.

3. The compensation device according to one of claim 1 and claim 2, wherein said outlet orifice of said second compensation chamber is in communication with an inside of said second compensation chamber through a hole extending through an upper wall of said second compensation chamber, opposite said bottom wall of said second compensation chamber.

4. The compensation device according to claim 3, wherein said upper wall of said second compensation chamber is convex toward an outside of said second compensation chamber, wherein said hole extending through said upper wall of said second compensation chamber is formed through a highest point of said upper wall when said compensation device is arranged in said operating position.

5. The compensation device according to one of claim 1 and claim 2, wherein said first compensation chamber further comprises a conveyance duct, wherein a first end of said conveyance duct is in communication with said inlet orifice of said first compensation chamber and a second end of said conveyance duct, opposite said first end, is disposed below said first opening in said first compensation chamber.

6. A printing unit, comprising:

a printing head comprising:

a printing surface, a plurality of nozzles disposed on said printing surface, a feed orifice in communication with said plurality of nozzles, and a discharge orifice in communication with said plurality of nozzles; and a compensation device comprising:

a first compensation chamber, configured to contain ink, said first compensation chamber comprising a bottom wall, an outlet orifice extending through said bottom wall, and an inlet orifice opposite said bottom wall, a second compensation chamber, configured to contain ink, said second compensation chamber comprising a bottom wall, an inlet orifice extending through said bottom wall, and an outlet orifice opposite said bottom wall, and a vent means configured to allow an outflow of air from said first compensation chamber and from said second compensation chamber, said vent means comprising a first opening in said first compensation chamber, different from said inlet orifice and said outlet orifice of said first compensation chamber, a second opening in said second compensation chamber, different from said inlet orifice and said outlet orifice of said second intermediate chamber, and an intermediate chamber, wherein said first opening is in communication with said second opening via said compensation chamber, and wherein, when said compensation device is in an operating position in which said bottom wall of said first compensation chamber and said bottom wall of said second compensation chamber respectively define a lowermost wall of said first compensation chamber and a lowermost wall of said second compensation chamber, said second opening is lower than said first opening;

wherein, said outlet orifice of said first compensation chamber is in communication with said feed orifice of said printing head, and said inlet orifice of said second compensation chamber is in communication with said discharge orifice of said printing head.

7. The printing unit according to claim 6, wherein a first circuit defined by said first opening, said second opening, and by said intermediate chamber is configured to generate a resistance to an outflow of ink that exceeds a resistance generated by a second circuit defined by said outlet orifice of said first compensation chamber, said printing head, and said inlet orifice of said second compensation chamber.

8. The printing unit according to one of claim 6 and claim 7, further comprising:

a levelling tank, configured to contain ink, and a feed duct, wherein said levelling tank is in communication with said inlet orifice of said first compensation chamber via said feed duct.

9. The printing unit according to claim 8, wherein said levelling tank is lower than said nozzles of said printing head.

10. The printing unit according to claim 6, further comprising:

a collection tank, a discharge duct, and a motorized valve operable to open and close said discharge duct, wherein said collection tank is in communication with said outlet orifice of said second compensation chamber via said discharge duct.

11. A printing unit comprising:

a printing head comprising a plurality of nozzles, a feed orifice configured to provide ink to said plurality of nozzles, and a discharge orifice in communication with said plurality of nozzles;

a compensation device comprising:

a first compensation chamber comprising:

an first outlet orifice formed in a bottommost wall of said first compensation chamber, the first outlet orifice in communication with the feed orifice of the printing head, a first inlet orifice formed in an uppermost wall of said first compensation chamber, and a first vent formed in a wall of the first compensation chamber between the first outlet orifice and the first inlet orifice;

a second compensation chamber comprising:

a second inlet orifice formed in a bottommost wall of said second compensation chamber, the second inlet orifice in communication with the discharge orifice of the printing head, a second outlet orifice formed in an uppermost wall of said second compensation chamber, and a second vent formed in a wall of the second compensation chamber between the second outlet orifice and the second inlet orifice; and an intermediate chamber, wherein the first vent is in communication with the second vent via the intermediate chamber; and wherein the first vent is disposed above the second vent.

* * * * *